US012104392B2

(12) United States Patent
Stewart-Brown et al.

(10) Patent No.: US 12,104,392 B2
(45) Date of Patent: Oct. 1, 2024

(54) POST HOLE COVER

(71) Applicant: EPS World Wide Holdings Pty Ltd, Mudjimba (AU)

(72) Inventors: Luisa Danielle Stewart-Brown, Mudjimba (AU); Scott Ian Brown, Mudjimba (AU)

(73) Assignee: EPS WORLD WIDE HOLDINGS PTY LTD., Mudjimba (AU)

( * ) Notice: Subject to any disclaimer, the term of this patent is extended or adjusted under 35 U.S.C. 154(b) by 416 days.

(21) Appl. No.: 17/310,787

(22) PCT Filed: Jan. 31, 2020

(86) PCT No.: PCT/AU2020/050068
§ 371 (c)(1),
(2) Date: Aug. 24, 2021

(87) PCT Pub. No.: WO2020/181318
PCT Pub. Date: Sep. 17, 2020

(65) Prior Publication Data

US 2022/0127866 A1 Apr. 28, 2022

(30) Foreign Application Priority Data

Mar. 8, 2019 (AU) ..... 2019900772
Jun. 18, 2019 (AU) ..... 2019902105

(51) Int. Cl.
*E04G 21/32* (2006.01)

(52) U.S. Cl.
CPC ..... *E04G 21/3252* (2013.01)

(58) Field of Classification Search
CPC ..... E04G 21/3252; E02D 31/00; E04H 17/20; E04H 17/006
See application file for complete search history.

(56) References Cited

U.S. PATENT DOCUMENTS 3,699,730 A * 10/1972 Humphrey ..... F16J 13/02 49/463
4,890,425 A * 1/1990 Mamula ..... E02D 31/02 52/169.5
5,040,251 A * 8/1991 Hanford ..... A63B 71/028 4/496
5,979,117 A * 11/1999 Fuller ..... E02D 29/14 404/25

(Continued)

FOREIGN PATENT DOCUMENTS

GB 2254349 A 10/1992
GB 2324321 A 10/1998
WO 2020181318 A1 9/2020

OTHER PUBLICATIONS

PCT/ AU2020/050068 International Search Report and Written Opinion dated Mar. 13, 2020, 10 pages.

(Continued)

*Primary Examiner* — Babajide A Demuren
(74) *Attorney, Agent, or Firm* — Boisbrun Hofman, PLLC

(57) ABSTRACT

The present invention relates to a post hole cover comprising a cover portion adapted to substantially overlie a post hole and one or more ground-engaging members extending from the cover portion, wherein the cover portion includes one or more installation portions adapted to facilitate installation of the post hole cover over the post hole.

28 Claims, 6 Drawing Sheets

(56) References Cited

U.S. PATENT DOCUMENTS

| | | | | |
|---|---|---|---|---|
| 6,453,603 | B1 * | 9/2002 | Baker | A01M 1/2011 43/132.1 |
| 6,682,257 | B1 * | 1/2004 | Zappe | E02D 29/149 404/25 |
| 10,934,667 | B2 * | 3/2021 | Kirk | E02F 5/20 |
| 10,995,468 | B2 * | 5/2021 | Millman | E02D 29/1445 |
| 11,255,067 | B2 * | 2/2022 | Millman | E02D 29/1427 |
| 2008/0075532 | A1 * | 3/2008 | Boyd | E02D 17/10 404/25 |
| 2008/0168726 | A1 * | 7/2008 | Yang | E04F 15/02488 52/301 |
| 2009/0288357 | A1 * | 11/2009 | Kubicek | E04C 5/161 52/301 |
| 2009/0313927 | A1 * | 12/2009 | Myers, Jr. | E04G 21/3252 52/301 |

OTHER PUBLICATIONS

Tennis Post Hole Cover Pair by Sportzing Tennis Australia [retrieved from internet on Feb. 27, 2020] <URL: https://sportzingtennis.com.au/products/tennis-net-post-hole-cap >Published on Mar. 17, 2018 as per Wayback Machine; Entire Document.

Cover Plate 80NB Model: SDCCP80 [retrieved from internet on Feb. 27, 2020] <URL: https://laps.com.au/product/cover-plate-model-sdcp80/ >Published on Mar. 23, 2015 as per Wayback Machine; Entire Document.

* cited by examiner

POST HOLE COVER

TECHNICAL FIELD

The present invention relates to a cover. In particular, the present invention relates to a post hole cover.

BACKGROUND ART there are many industries in which post holes (also referred to as pier holes) are dug. For instance, in the building industry, post holes are dug to accommodate the piers or stumps of a building or structure under construction. Post holes are also dug during the construction of fences and retaining walls, or the installation of telegraph poles.

After forming a post hole, but before a post is placed therein, an open post hole can present a significant injury risk to people in the area. In addition, during rain events, post holes can fill with water and dirt or debris, requiring the use of external pumps to clear the hole. Further, cave-ins in wet post holes can result in further excavation being required, thereby increasing costs.

In practice, workers cover post holes with pieces of wood (such as plywood) or erect temporary barriers around post holes to prevent injury. However, these measures do not entirely eliminate the risk of injury: a person that stands on a relatively flimsy plywood cover could fall through and into the post hole.

Thus, there would be an advantage if it were possible to provide a post hole cover that was quick and easy to install and remove, but that reduced or eliminated the safety risks associated with temporary covers.

It will be clearly understood that, if a prior art publication is referred to herein, this reference does not constitute an admission that the publication forms part of the common general knowledge in the art in Australia or in any other country.

SUMMARY OF INVENTION

The present invention is directed to a post hole cover, which may at least partially overcome at least one of the abovementioned disadvantages or provide the consumer with a useful or commercial choice.

With the foregoing in view, the present invention in one form, resides broadly in a post hole cover comprising a cover portion adapted to substantially overlie a post hole and one or more ground-engaging members extending from the cover portion, wherein the cover portion includes one or more installation portions adapted to facilitate installation of the post hole cover over the post hole.

In the present specification, the term "post hole" is used to describe holes dug for any suitable purpose, and is intended to encompass such things as holes dug for telegraph posts, piers or stumps, fence posts, tree planting, retaining walls, street signs, traffic lights or the like. It is intended that the term "post hole" encompasses other holes, such as drill holes for exploration in the mining, oil and gas industries, blast holes, and so on.

The cover portion may be of any suitable size, shape or configuration. However, it is envisaged that the cover portion may be of sufficient width or diameter to substantially overlie the post hole with which it is being used. Preferably, the cover portion is adapted to entirely overlie the post hole with which it is being used. Thus, it is envisaged that the post hole cover of the present invention may be fabricated in a number of different sizes in order to cover post holes of varying diameter.

In a preferred embodiment of the invention, the cover portion may be substantially circular in shape. However, it is envisaged that the cover portion could be any other suitable shape, such as square, rectangular, triangular, oval or the like. The cover portion could also be of an irregular shape. It will be understood that the feature of shape referred to herein refers to the shape of the cover portion when viewed from above (i.e. in plan view).

The cover portion may be of any suitable cross-sectional shape. For instance, the cover portion may be substantially planar across at least a portion of its diameter. In this embodiment of the invention, the cover portion may be provided with a handle portion extending outwardly from the cover portion.

More preferably, the cover portion has a non-planar cross-sectional shape. In a preferred embodiment of the invention, the cover portion may include a raised region. Preferably, the raised region may be a substantially central region of the cover portion. Thus, in this embodiment of the invention, the cover portion may be provided with an apex in the central region thereof. Alternatively, the cover portion may be provided with a convex shape such that the central region of the cover portion is located at a height above the periphery of the cover portion. Thus, it is envisaged that the cover portion may be substantially dome shaped. By providing the cover portion with a dome shape, the post hole cover may be relatively resistant to breakage or damage in the event that it is stepped on or an object is placed thereon.

The post hole cover may be adapted to support any suitable weight thereon. However, it is envisaged that the post hole cover may be of sufficient strength to support at least the weight of a human being thereon. Thus, the post hole cover may be adapted to support at least about 100 kg thereon. More preferably, the post hole cover may be adapted to support at least about 150 kg thereon. Even more preferably, the post hole cover may be adapted to support at least about 200 kg thereon.

In a preferred embodiment of the invention, the cover portion may be provided with one or more grip portions. More preferably, an upper surface of the cover portion may be provided with one or more grip portions. The grip portions may be of any suitable form, although it is envisaged that the grip portions may be provided so as to provide a more stable footing to a person that steps on the post hole cover, particularly in wet conditions. In a preferred embodiment of the invention, the grip portions may comprise regions of relatively high grip material. Alternatively, the grip portions may be one or more projections, lands or the like. In a most preferred embodiment of the invention, the grip portions may comprise one or more ribs extending at least partially about the cover portion. In some embodiments of the invention, a plurality of ribs may be provided, the plurality of ribs being provided spaced apart from one another between the periphery of the cover portion and the central region thereof. Preferably, the grip portions comprise a plurality of annular ribs extending at least partway about the cover portion (and, in particular, the central region of the cover portion).

In a preferred embodiment of the invention, the post hole cover may be provided with one or more handle portions. The handle portions may be provided at any suitable location on the post hole cover, although in a preferred embodiment of the invention, the handle portions may be provided on the cover portion.

It is envisaged that the handle portions could extend outwardly from the cover portion. More preferably, however, the handle portions may extend into the upper surface of the cover portion in order to avoid creating a trip hazard. The handle portions may be of any suitable form to allow a user to hold the post hole cover by the handle portions, and may include one or more finger holes, hand grips or the like, or any suitable combination thereof. In a preferred embodiment of the invention, the handle portions may comprise at least a pair of recesses, slots, channels or the like into which a user may at least partially insert their fingers in order to grip the post hole cover. The at least a pair of recesses, slots or channels may be oriented at any suitable angle to one another. Preferably, however, the at least a pair of recesses, slots or channels are positioned substantially parallel to one another.

The handle portions may be provided at any suitable location on the cover portion. However, in a preferred embodiment of the invention, the handle portions may be provided in the central region of the cover portion.

In some embodiments of the invention, the post hole cover may be provided with one or more reinforcing members. The reinforcing members may be of any suitable form, although it is envisaged that the one or more reinforcing members may be adapted to increase one or more of the strength, rigidity, load-bearing capability and durability of the post hole cover (for instance, when a person stands on the post hole cover, or an object is placed on the post hole cover).

In a preferred embodiment, the one or more reinforcing members may be provided on the cover portion. More preferably, the one or more reinforcing members may be provided on a lower surface of the cover portion. Even more preferably, the one or more reinforcing members may be provided on a central region of the lower surface of the cover portion, although it is envisaged that the reinforcing members may extend from the central region to at least partway to the periphery of the cover portion. Thus, in this embodiment, it is envisaged that the one or more reinforcing members may be located on the opposed surface of the cover portion to the highest portion thereof.

The one or more reinforcing members may comprise one or more projections. Preferably, the one or more projections extend outwardly from the lower surface of the cover portion. In some embodiments of the invention, the one or more projections may be relatively elongate. In these embodiments, it is envisaged that the one or more projections may comprise ribs. Preferably, the ribs are in contact with the lower surface of the cover portion along their entire length.

The ribs may all extend in the same direction as one another. Alternatively, the ribs may extend in two or more directions. In a preferred embodiment, at least one rib may extend in a first direction, and at least one rib may extend in a second direction, the second direction being different to the first direction. Most preferably, a first plurality of ribs may extend in a first direction, while a second plurality of ribs may extend in a second direction. Preferably, the first plurality of ribs and the second plurality of ribs intersect one another.

The first direction and the second direction may be oriented at any suitable angle to another. Preferably, the first direction and the second direction are oriented at an angle of between about 10° and about 170° to one another. More preferably, the first direction and the second direction are oriented at an angle of between about 30° and about 150° to one another. Still more preferably, the first direction and the second direction are oriented at an angle of between about 50° and about 130° to one another. Yet more preferably, the first direction and the second direction are oriented at an angle of between about 70° and about 110° to one another. Most preferably, the first direction and the second direction are oriented at an angle of about 90° to one another.

In some embodiments of the invention, the post hole cover may comprise at least one rib extending in a third direction. In other embodiments of the invention, the post hole cover may include at least one rib extending in a fourth direction. More preferably, a third plurality of ribs may extend in a third direction, while a fourth plurality of ribs may extend in a fourth direction. Preferably, the third direction is different to the fourth direction. More preferably, the third direction and the fourth direction are different to both the first direction and the second direction. Preferably, the third direction and the fourth direction are oriented at an angle of between about 10° and about 170° to one another. More preferably, the third direction and the fourth direction are oriented at an angle of between about 30° and about 150° to one another. Still more preferably, the third direction and the fourth direction are oriented at an angle of between about 50° and about 130° to one another. Yet more preferably, the third direction and the fourth direction are oriented at an angle of between about 70° and about 110° to one another. Most preferably, the third direction and the fourth direction are oriented at an angle of about 90° to one another.

In a particular embodiment of the invention, the first direction and the second direction are oriented at an angle of approximately 45° to each of the third direction and the fourth direction.

Preferably, the ribs extending in the third direction and the fourth direction may be located so as to abut or intersect at least one rib extending in the first and/or second direction. It is envisaged that, in some embodiments of the invention, at least one of the ribs extending in the third direction and the fourth direction may extend to a point at or adjacent the periphery of the post hole cover.

It is envisaged that the provision of the ribs extending in the third direction and the fourth direction may serve to increase one or more of the strength, rigidity, load-bearing capability and durability of the post hole cover.

In some embodiments of the invention, it is envisaged that the handle portions may comprise one or more side walls and/or base walls forming the recesses, slots or channels. In this embodiment of the invention, the one or more side walls and/or base walls ay be associated with, or form a part of, the reinforcing members.

As previously stated, the post hole cover includes one or more ground-engaging members extending from the cover portion. The ground-engaging members may extend from any suitable portion of the cover portion and at any suitable angle thereto. In a preferred embodiment, the ground-engaging members extend from the lower surface of the cover portion.

It is envisaged that the ground-engaging members may engage the ground near the rim of the post hole. Thus, in other embodiments, the ground-engaging members may extend from the periphery of the cover portion. It will be understood that the ground-engaging members may not engage the ground immediately adjacent to the rim of the post hole, as the ground immediately adjacent to the rim of the post hole may be unstable and could cave in. Therefore, it is envisaged that a margin will be left between the rim of the post hole and the point at which the ground-engaging members engage the ground surface. The margin will vary depending on a number of factors, such as the amount of moisture in the soil, climatic conditions, the type of soil and so on.

Preferably, the ground-engaging members extend substantially downwardly from the cover portion. Thus, in some embodiments of the invention the ground-engaging members extend at an angle of between about 85° and about 95° to the periphery of the cover portion. More preferably, the ground-engaging members extend at an angle of about 90° to the periphery of the cover portion.

The ground-engaging members may engage the ground in any suitable manner. For instance, the ground-engaging members may be located in abutment with the ground surface. More preferably, at least a portion of the ground-engaging members penetrates the ground surface. In this way, the post hole cover may effectively secured or anchored to the ground surrounding the post hole. This prevents accidental removal or movement of the post hole cover that would otherwise expose the open post hole.

The ground-engaging members may penetrate the ground surface in any suitable manner. Preferably, however, the ground-engaging members may be shaped so as to facilitate penetration of the ground. For instance, the ground-engaging portions may be shaped so as to form one or more points adapted to penetrate the ground surface adjacent to the post hole. Thus, in a particular embodiment of the invention, the ground-engaging portions may be substantially triangular in shape, with a point or apex of the triangle adapted to penetrate the ground surface. The ground-engaging members may include a penetration portion, such as one or more teeth, blades or the like adapted to penetrate the ground surface. The penetration portion may be formed separately from the ground-engaging member and be adapted for fixed or removable attachment thereto. More preferably, the penetration portion may be formed integrally with the ground-engaging member.

The post hole cover may be provided with any suitable number of ground-engaging members, and it will be understood that the number of ground-engaging members may vary depending on the size of the post hole cover, the nature of the ground surface, the shape of the cover portion and so on. Preferably, however, the post hole cover may be provided with at least a pair of ground-engaging members. The ground-engaging members may be spaced at any suitable distance from one another about the periphery of the cover portion. Preferably, the ground-engaging members are positioned substantially equidistantly from one another about the periphery of the cover portion.

In a preferred embodiment of the invention, the post hole cover includes at least three ground-engaging members. In one specific embodiment, the post hole cover includes four ground-engaging members.

The ground-engaging members may be of any suitable length, and it will be understood that the length of the ground-engaging members may vary depending on the size of the post hole cover, the type of ground surface and so on. The ground-engaging members on a post hole cover may be all substantially the same length. Alternatively, at least one ground-engaging member may be of a different length to other ground-engaging members on the same post hole cover.

The ground-engaging members may penetrate the ground surface to any suitable depth. However, in a preferred embodiment of the invention, the entire ground-engaging member penetrates the ground surface. In this embodiment, the ground-engaging members penetrate the ground surface to such a depth that at least a portion of the cover portion (and, more specifically, at least a portion of the periphery of the cover portion) is located in abutment with the ground surface. Not only does this ensure that the post hole cover is securely anchored in place, but it also minimises or eliminates the risk of a person tripping over a post hole cover installed such that a gap between the ground surface and the periphery of the cover portion is present. In addition, by locating at least a portion of the periphery of the cover portion in abutment with the ground surface, accidental removal or movement of the post hole cover from over the post hole may be reduced or eliminated.

In some situations, such as when the ground is wet or soft, or the soil is particularly loose, the post hole cover may penetrate the ground under its own weight. Alternatively, a user may provide a downward force to the post hole cover with their hands.

In other situations, such as when the ground is relatively dry, the soil is compacted and so on, a user may make use of the installation portions in order to facilitate the installation of the post hole cover over the post hole.

The installation portions may be of any suitable form. Preferably, however, the purpose of the installation portions is to provide one or more regions of the post hole cover to which pressure may be applied to facilitate penetration of the ground surface by the ground-engaging members.

Pressure may be applied to the installation portions using any suitable technique. For instance, a person may apply pressure to the installation portions using their hands, feet or the like. More preferably, a user may use a tool (such as, but not limited to, a hammer, mallet or the like) to apply pressure to the installation portions. In this embodiment of the invention, it is envisaged that the installation portions may comprise regions of the cover portion that are reinforced or fabricated from impact-resistant materials in order to withstand impact from the tool.

In some embodiments, the installation portions may form part of the convex surface of the cover portion. More preferably, however, the installation portions may be formed so that the force applied by the user to the installation portion is directed substantially downwardly so as to more efficiently assist in achieving penetration of the ground surface by the ground-engaging members. Thus, in this embodiment of the invention, the installation portions may comprise substantially planar portions of the cover portion. In this way, the installation portions may be oriented at approximately 90° to the vertical, so that a force applied to the installation portions is directed substantially downwardly (i.e. substantially vertically downwardly).

Preferably, the substantially planar installation portions may comprise lands, shoulders or recesses in the cover portion (collectively referred to hereinafter as "lands" for convenience). The lands may be provided at any suitable location on the cover portion, although in a preferred embodiment of the invention, the lands may be provided in the upper surface of the cover portion. Even more preferably, the lands may be provided at or adjacent the periphery of the cover portion. It is envisaged that the lands may effectively comprise cut-out portions of the cover portion. It is envisaged that providing lands in this manner may be advantageous as it may reduce or eliminate damage to the cover portion that may occur if a tool such as a hammer is impacted on the convex surface of the cover portion.

In other embodiments of the invention, the installation portions may be raised portions. Thus, in this embodiment of the invention, the installation portions may comprise shoulders, lands or the like that are positioned above the surface of the cover portion adjacent to the installation portions.

The installation portions may be of any suitable size. Preferably, the installation portions may be of at least sufficient size that a told such as a hammer or mallet may be impacted on the installation portions without contacting any other part of the post hole cover. In other embodiments of the invention, the installation portions may be of at least sufficient size to accommodate at least a portion of a user's footwear (such as a shoe or boot). In some embodiments of the invention, the installation portions may be reinforced. Any suitable method of reinforcing the installation portions may be used. For instance, the thickness of material in the installation portions may be increased relative to the rest of the post hole cover, or the installation portions may be at least partially fabricated from an impact-resistant material.

The installation portions may be provided at any suitable location in the cover portion. Preferably (and as previously stated) the installation portions may be provided at or adjacent the periphery of the cover portion. More preferably, the at least one of the installation portions may be associated with a ground-engaging member. In this embodiment of the invention, it is envisaged that the installation portion may at least partially overlie, or be positioned adjacent, a ground-engaging member.

In a most preferred embodiment of the invention, each ground-engaging member may be associated with an installation portion. In particular, an installation portion may at least partially overlie, or be positioned adjacent, each ground-engaging portion. In this way, the force applied to the installation portions may be applied in the vicinity of the ground-engaging portions so as to enhance the penetration of the ground surface by the ground-engaging members.

In some embodiments of the invention, it is envisaged that at least one installation portion may be provided that does not at least partially overlie, or be positioned adjacent, a ground-engaging member. Similarly, it is envisaged that at least one ground-engaging member may be provided that is not at least partially overlain by an installation portion.

In some embodiments of the invention, the radius of the cover portion may be the same about its entire circumference. Alternatively, the radius of the cover portion may vary about its circumference. In some embodiments of the invention, the radius of the cover portion in the vicinity of the ground-engaging members may be greater than the radius of the cover portion between adjacent ground-engaging members. By providing the cover portion with a greater radius in the vicinity of the ground-engaging members, it is envisaged that two or more of the post hole covers may be stacked together for ease of storage or transportation. Thus, the post hole cover of the present invention may be a stackable post hole cover.

The post hole cover of the present invention may be fabricated from any suitable material, or combination of materials. Preferably the post hole cover may be fabricated from a relatively strong, rigid and/or durable material. For instance, the post hole cover may be fabricated from a polymeric material, a metal or metal alloy, wood, fibreglass or a combination thereof. Preferably, the post hole cover is fabricated from a polymeric material. Any suitable polymeric material may be used, although in a preferred embodiment of the invention the polymeric material may be a polycarbonate, or combination of polycarbonates. The post hole cover may be fabricated using any suitable technique, such as, but not limited to, casting, moulding or the like. Preferably, the post hole cover is of unitary construction.

In some embodiments of the invention, the material from which the post hole cover is fabricated may be provided with certain properties. For instance, the post hole cover may be fabricated from a UV-resistant material, a chemical-resistant material, a fire resistant material, an impact resistant material or the like, or any suitable combination thereof.

It is envisaged that the post hole cover may be fabricated in any suitable colour. Preferably, however, the post hole cover may be fabricated in a colour having relatively high visibility. Thus, the post hole cover may be fabricated from a coloured material, or a material to which a relatively high visibility dye or colour has been added. Any suitable high visibility colour may be used, such as, but not limited to, yellow, green, orange, pink, a fluorescent or phosphorescent colour, or a combination thereof.

In some embodiments of the invention, the upper surface of the cover portion may be provided with indicia. Any suitable indicia may be used, and may include safety information, use information, safe work load information and the like. The indicia may be provided on the cover portion using any suitable technique. For instance, the indicia may be printed, etched, engraved, and so on on the surface of the cover portion.

It is envisaged that, in order to remove a post hole cover from over the post hole (such as when the post hole is to be filled), a user may pull the cover out of the ground. This may be possible in particular when the ground is wet or the soil is particularly loose. However, in other situations (such as when the ground if dry or the soil is compacted) a user may be required to lever the cover out of the ground. This may be achieved using any suitable technique, although it is envisaged that a tool such as a shovel or crowbar may be used. The tool may be positioned under the periphery of the cover portion and then the tool used as a lever to extract the cover from the ground.

It is envisaged that the post hole cover of the present invention may be reusable.

The present invention provides numerous advantages over the prior art. By securely positioning a durable cover over a post hole, the risk of injury to a worker caused by either stepping on a flimsy cover, or by stepping into an uncovered post hole, may be reduced or eliminated. In addition, placing a cover over a post hole reduces or eliminates the influx of water and debris into the post hole, thereby ensuring that the post hole is in condition for use at all times without requiring additional drainage or the like.

The present invention allows for the easy and efficient installation of the post hole cover, as well as reducing or eliminating the risk of the unwanted or accidental removal of the cover from its position over the post hole.

Further, the post hole cover of the present invention is both stackable and reusable.

Any of the features described herein can be combined in any combination with any one or more of the other features described herein within the scope of the invention.

The reference to any prior art in this specification is not, and should not be taken as, an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

Figure 1:
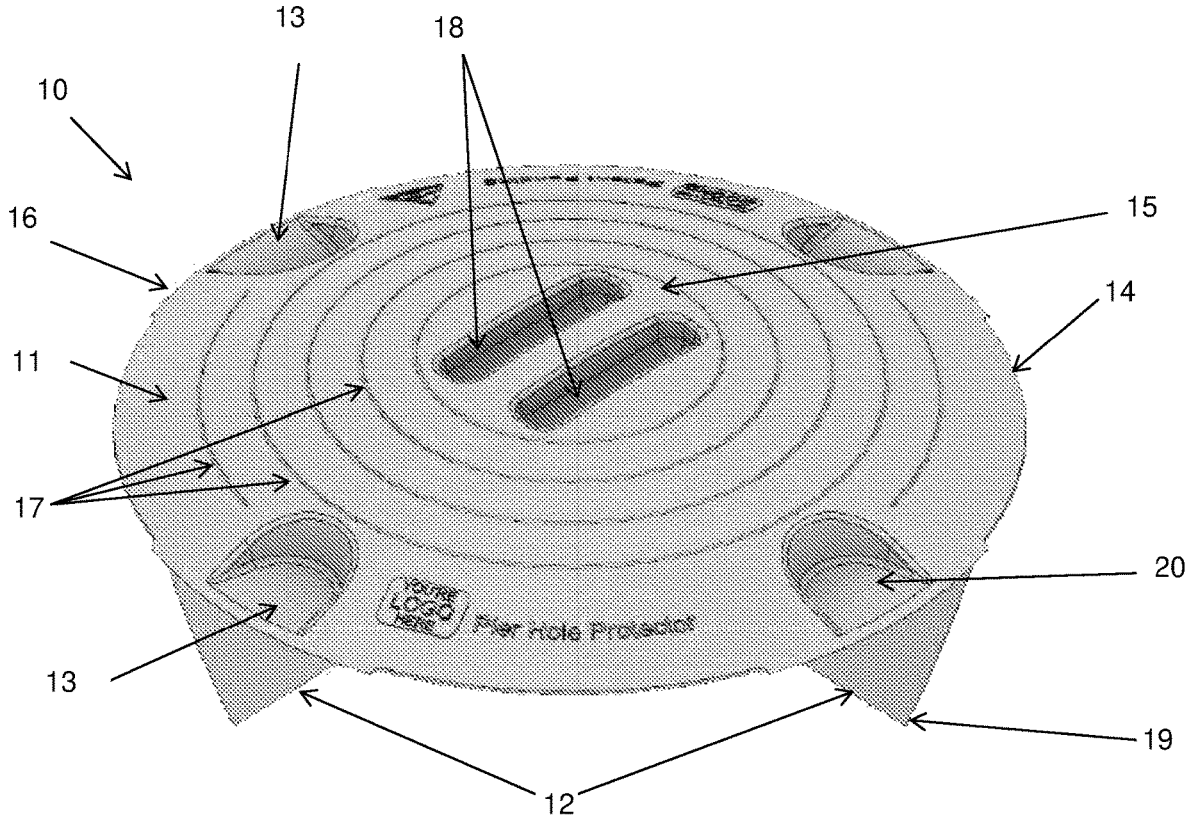
FIG. 1 illustrates a top isometric view of a post hole cover according to an embodiment of the present invention.

FIG. 1 illustrates a top isometric view of a post hole cover 10 according to an embodiment of the present invention. The post hole cover 10 includes a cover portion 11, a plurality of ground-engaging members 12 depending from the cover portion 11 and a plurality of installation portions 13.

In the embodiment of the invention illustrated in FIG. 1, the cover portion is generally circular. However, the radius of the cover portion 11 varies about the circumference. Specifically, in the regions of the cover portion 11 in which the ground-engaging members 12 are located, the radius of the cover portion 11 is greater than the regions 14 between adjacent ground-engaging members 12. In this way, a number of post hole covers 10 may be stacked on top of each other (best seen in FIG. 4). This improves the ease with which the post hole covers 10 can be stored and transported.

The cover portion 11 is generally convex in shape, with a central region 15 of the cover portion 11 located at a height above the periphery 16 of the cover portion 11. In this way, the cover portion 11 is generally in the shape of a dome.

A plurality of annular (or semi-annular) ribs 17 is located on the upper surface of the cover portion 11. The ribs 17 are spaced apart from one another between the central region 15 and the periphery 16 of the cover portion 11. The ribs 17 provide additional grip for a user that steps or stands on the upper surface of the cover portion 11. This is particularly of assistance in wet conditions so as to reduce or eliminate the risk of injury to workers.

The central region 15 of the cover portion 11 includes a pair of channels 18 extending into the upper surface of the cover portion 11. The pair of channels 18 are positioned substantially parallel to one another. The pair of channels 18 act as handles and allow a user to partially insert their hand into the channels 18 to grip the post hole cover 10.

As previously stated, the post hole cover 10 includes a plurality of ground-engaging members 12. The ground-engaging members 12 extend substantially downwardly from at or adjacent the periphery 16 of the cover portion 11. It is envisaged that, in use, the cover portion 11 will be positioned so as to overlie a post hole (not shown) and the ground-engaging members 12 will engage the ground surface near the rim of the post hole.

In the embodiment of the invention shown in FIG. 1, the ground-engaging members 12 are spaced equidistantly from one another about the periphery 16 of the cover portion 11. The ground-engaging members 12 are substantially triangular in shape and are oriented such that an apex or point 19 of each ground-engaging member 12 is adapted to penetrate the ground surface, thereby securing or anchoring the post hole cover 10 to the ground.

The post hole cover 10 of FIG. 1 has the same number of ground-engaging members 12 as installation portions 13, and each installation portion 13 is associated with a ground-engaging member 12. Specifically, each installation portion 13 is located on the cover portion 11 so as to overlie, or be positioned adjacent, a ground-engaging member 12.

In use, it is envisaged that a user will position the post hole cover 10 over a post hole (not shown). Once in position, the user will apply a downward force to the post hole cover 10 such that the ground-engaging members 12 penetrate the ground surface to secure the post hole cover 10 in place over the post hole. In the embodiment of the invention shown in FIG. 1, a user may impact a hammer or mallet (not shown) on the installation portions 13 in order to secure the post hole cover 10 to the ground.

The installation portions 13 are formed as recesses in the cover portion 11, and are provided with a substantially planar surface 20 on which the user impacts a hammer or mallet (not shown). The planar surface 20 in the installation portions 13 assists in ensuring that the force of the impact is directed downwardly into the ground-engaging members 12 (particularly when, as in FIG. 1, the installation portions 13 overlie, or be positioned adjacent, the ground-engaging members 12). However, by providing the installation portions 13 as recesses in the cover portion 11, damage to the cover portion 11 by impacting a hammer or mallet thereon may be reduced or eliminated.

Figure 2:
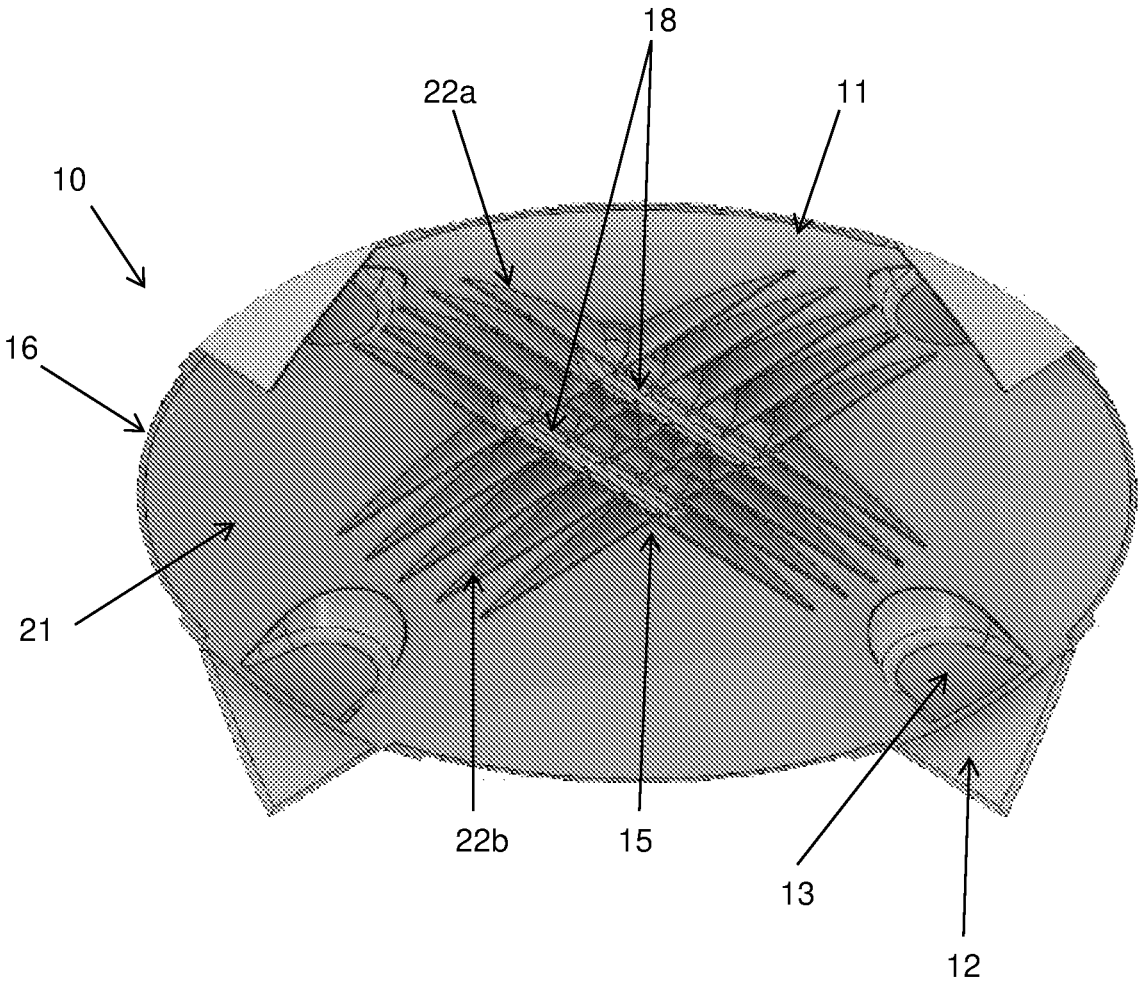
FIG. 2 illustrates a bottom isometric view of a post hole cover according to an embodiment of the present invention.

FIG. 2 illustrates a bottom isometric view of a post hole cover 10 according to an embodiment of the present invention. The post hole cover 10 of FIG. 2 is identical to that shown in FIG. 1.

In FIG. 2, the lower surface 21 of the cover portion 11 may be seen. The lower surface 21 is provided with a plurality of reinforcing members in the form of a first set of ribs 22*a* extending in a first direction and a second set of ribs 22*b* extending substantially perpendicularly to the first set of ribs 22*a*. The first set of ribs 22*a* and the second set of ribs 22*b* intersect one another so as to provide additional strength to the cover portion 11. The ribs 22*a*, 22*b* extend from the central region 15 of the cover portion 11 towards the periphery 16 thereof.

The walls of the handle portions 18 that extend into the upper surface of the cover portion 11 also form reinforcing members in the lower surface 21 of the cover portion 11.

In FIG. 2, the recesses formed by the installation portions 13 may be seen. It may also be seen that the installation portions 13 overlie, or are positioned adjacent, a central portion of each ground-engaging member 12.

Figure 3:
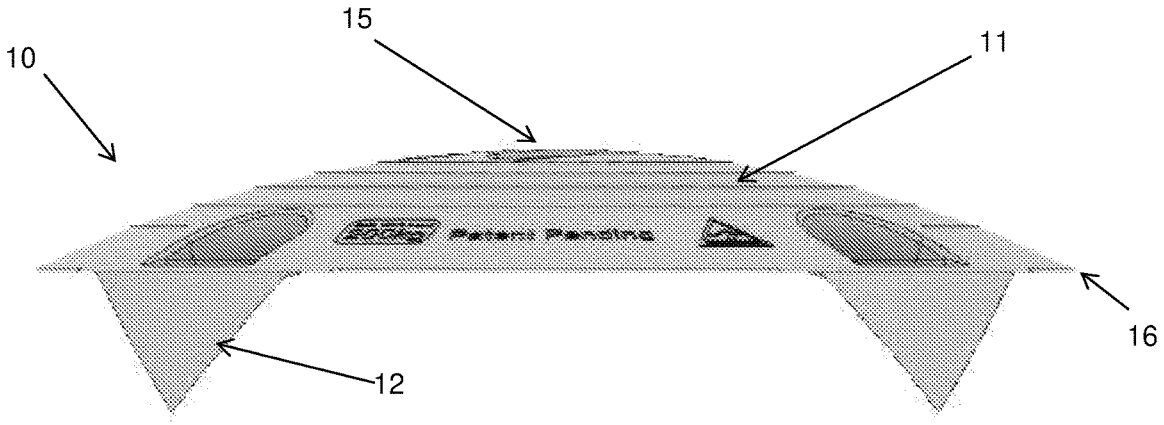
FIG. 3 illustrates a side view of a post hole cover according to an embodiment of the present invention.

FIG. 3 illustrates a side view of a post hole cover 10 according to an embodiment of the present invention. In this Figure, the convex shape of the cover portion 11 may be seen. By providing the cover portion 11 with a convex shape, the cover portion 11 effectively forms a dome with the highest point located in the central region 15 of the cover portion 11 sloping down to the periphery 16.

It is envisaged that, when the post hole cover 10 is in use, the ground-engaging members 12 will penetrate the ground surface to substantially their full height. In this way, the periphery 16 of the cover portion 11 will be located in abutment with, or close proximity to, the ground surface.

Figure 4:
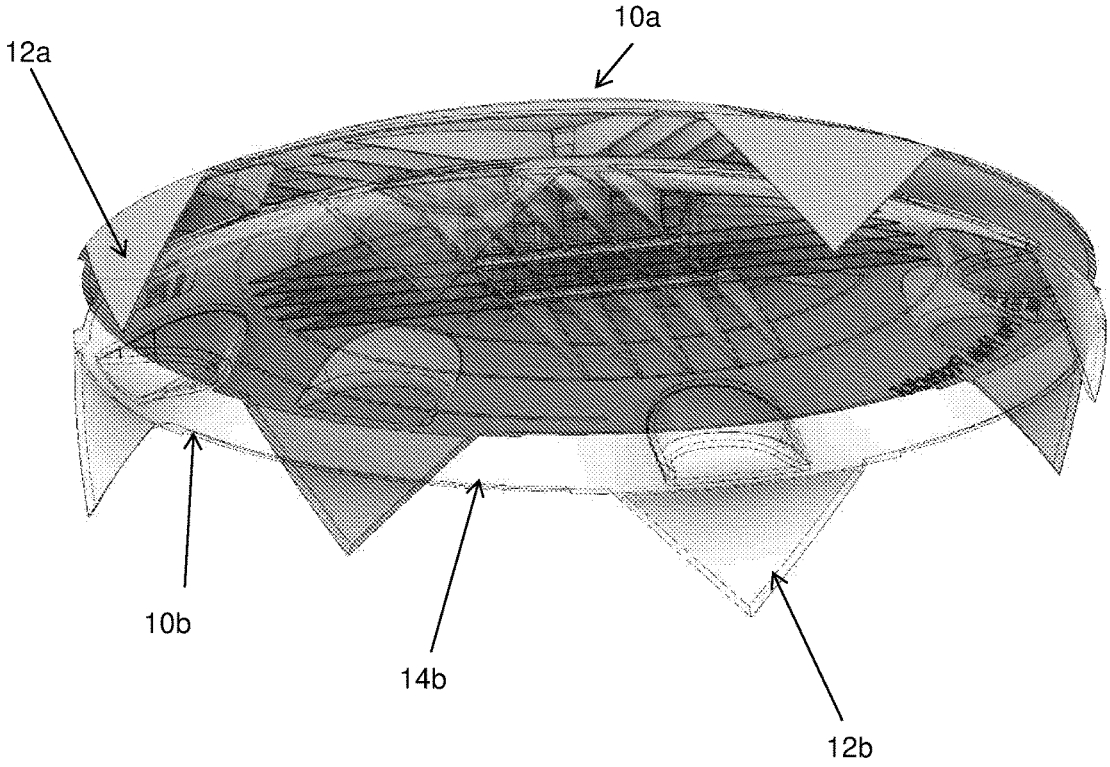
FIG. 4 illustrates a bottom isometric view of a pair of post hole covers according to an embodiment of the present invention.

FIG. 4 illustrates a bottom isometric view of a pair of post hole covers 10*a*, 10*b* according to an embodiment of the present invention. The post hole covers 10*a*, 10*b* are shown stacked on top of one another, for example for storage or transportation.

In order to stack the covers, the upper cover 10*a* is positioned so that the ground-engaging members 12*a* are positioned in the regions 14*b* between adjacent ground-engaging members 12*b* of the lower cover 10*b*. As the radius of the cover 10*b* is greater where ground-engaging members 12*b* are located than in the regions 14*b* between adjacent ground-engaging members 12*b*, the ground-engaging members 12*a* are able to be located in the regions 14*b*, thereby allowing the covers 10*a*, 10*b* to be stacked on top of each other.

Figure 5:
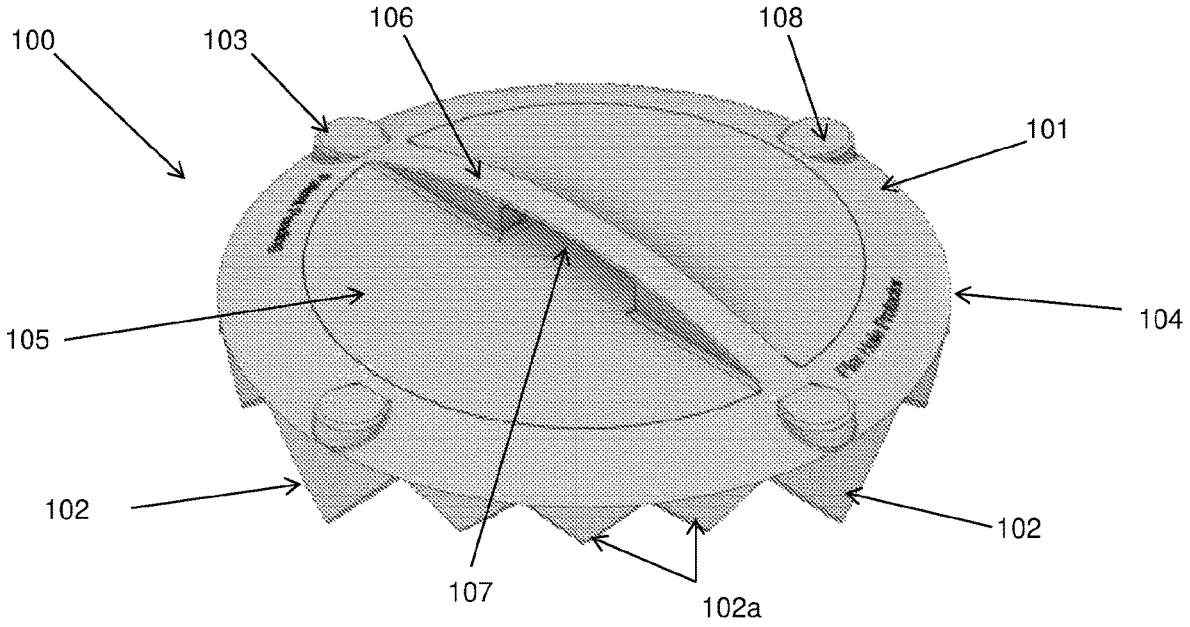
FIG. 5 illustrates a top isometric view of a post hole cover according to an embodiment of the present invention.

FIG. 5 illustrates a top isometric view of a post hole cover 100 according to an alternative embodiment of the present invention. The post hole cover 100 is similar to that shown in FIGS. 1 to 4 in that is includes a cover portion 101, a plurality of ground-engaging members 102 and a plurality of installation portions 103. However, some differences exist.

In the embodiment of the invention shown in FIG. 5, ground-engaging members 102 are provided around substantially the entire periphery 104 of the cover portion 101. The ground-engaging members 102 located adjacent the installation portions 103 are larger than the ground-engaging members 102*a* located between adjacent installation portions 103. In addition, the central region 105 of the cover portion 101 is substantially planar.

The central region 105 is provided with a handle member 106 that extends substantially upwardly therefrom. The handle portion 106 includes an opening 107 therein, via which a user may grip the handle portion 106 to carry or move the post hole cover 100.

The installation portions 103 of the post hole cover 100 illustrated in FIG. 5 extend upwardly from the cover portion adjacent the periphery 104 thereof. Each of the installation portions 103 is positioned to overlie, or at least be located adjacent to, a ground-engaging member 102.

The installation portions 103 all include a planar surface 108 on which a user may impact a hammer or mallet (not shown) in order to provide the downward force required for the ground engaging members 102 (and also 102*a*) to penetrate the ground surface. In this way, the post hole cover 100 may be secured or anchored to the ground over a post hole (not shown).

Figure 6:
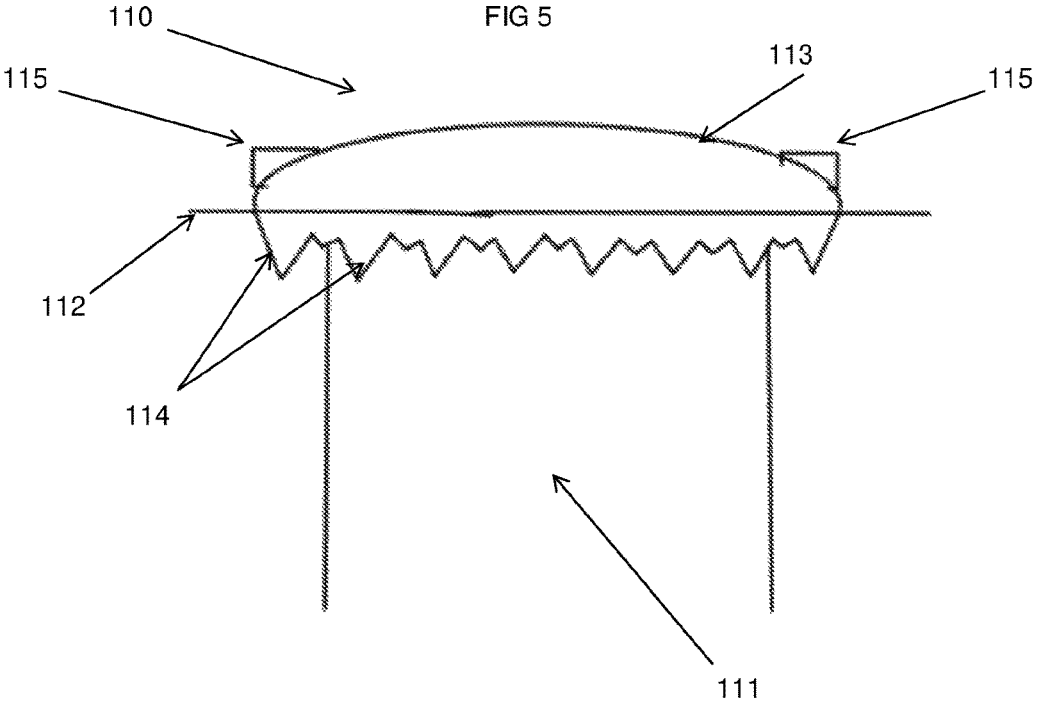
FIG. 6 illustrates a schematic view of a post hole cover when in use according to an embodiment of the present invention.

FIG. 6 illustrates a schematic view of a post hole cover 110 when in use according to an embodiment of the present invention. The post hole cover 110 is of slightly different construction to those illustrated in FIGS. 1 to 5. However, the principle of use is the same for all of the post hole covers illustrated in the Figures.

In FIG. 6, a post hole 111 has been dug into the ground from a surface 112 thereof. In order to minimise or eliminate injury to workers (through accidentally stepping into the post hole 111), the cover 110 is placed over the post hole 111 so that the cover portion 113 entirely overlies the post hole 111.

Initially, the ground-engaging members 114 are located so as to abut the ground surface 112. A user will them impact a tool such as a hammer or mallet (not shown) in the installation portions 115 in order to force the ground-engaging members 114 to penetrate the ground surface 112. The ground-engaging members 114 penetrate the ground to their full height so that the periphery of the cover portion 113 is located in abutment with, or close proximity to, the ground surface 112. This not only ensures that the cover 110 is securely retained in place (therefore reducing the likelihood of the accidental or unwanted removal or movement of the cover 110) but also reduced or eliminates a trip hazard that could occur if a relatively large gap was present between the ground surface 112 and the periphery of the cover portion 113.

It is envisaged that, in order to remove the cover 110 when the post hole 111 is to be filled, a user may pull the cover 110 out of the ground. This may be possible in particular when the ground is wet or the soil is particularly loose. However, in other situations (such as when the ground if dry or the soil is compacted) a user may be required to lever the cover 110 out of the ground. This may be achieved using any suitable technique, although it is envisaged that a tool such as a shovel or crowbar (not shown) may be used. The tool may be positioned under the periphery of the cover portion 113 and then the tool used as a lever to extract the cover 110 from the ground.

Figure 7:
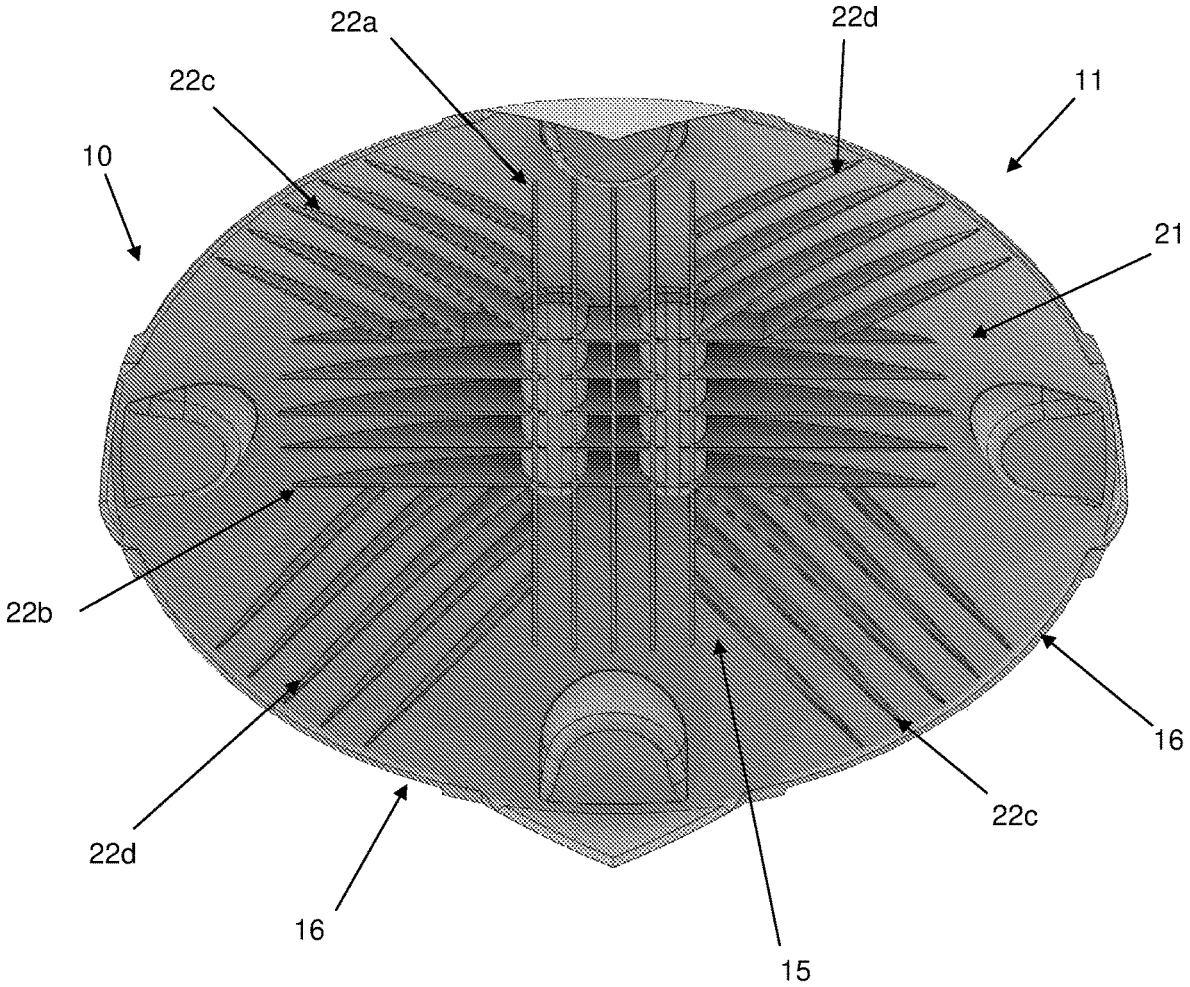
FIG. 7 illustrates a bottom isometric view of a post hole cover according to an embodiment of the present invention.

FIG. 7 illustrates a bottom isometric view of a post hole cover 10 according to an embodiment of the present invention. The post hole cover 10 of FIG. 7 is similar to that illustrated in FIG. 2, in that the lower surface 21 of the cover portion 11 may be seen. The lower surface 21 is provided with a plurality of reinforcing members in the form of a first set of ribs 22*a* extending in a first direction and a second set of ribs 22*b* extending substantially perpendicularly to the first set of ribs 22*a*. The first set of ribs 22*a* and the second set of ribs 22*b* intersect one another so as to provide additional strength to the cover portion 11. The ribs 22*a*, 22*b* extend from the central region 15 of the cover portion 11 towards the periphery 16 thereof.

However, the cover 10 shown in FIG. 7 differs from that of FIG. 2 in that the cover 10 of FIG. 7 includes a third set of ribs 22*c* extending in a third direction and a fourth set of ribs 22*d* extending in a fourth direction. The third set of ribs 22*c* and the fourth set of ribs 22*d* are positioned at an angle of approximately 90° to one another, and at an angle of approximately 45° to each of the first set of ribs 22*a* and the second set of ribs 22*b*.

In FIG. 7, it may be seen that each of the third set of ribs 22*c* and the fourth set of ribs 22*d* abuts or intersects at least one of the first set of ribs 22*a* and/or the second set of ribs 22*b* at a first end thereof. Each of the third set of ribs 22*c* and the fourth set of ribs 22*d* extends outwardly from the central region 15 of the cover 10 to a point at or adjacent the periphery 16 thereof.

Figure 8:
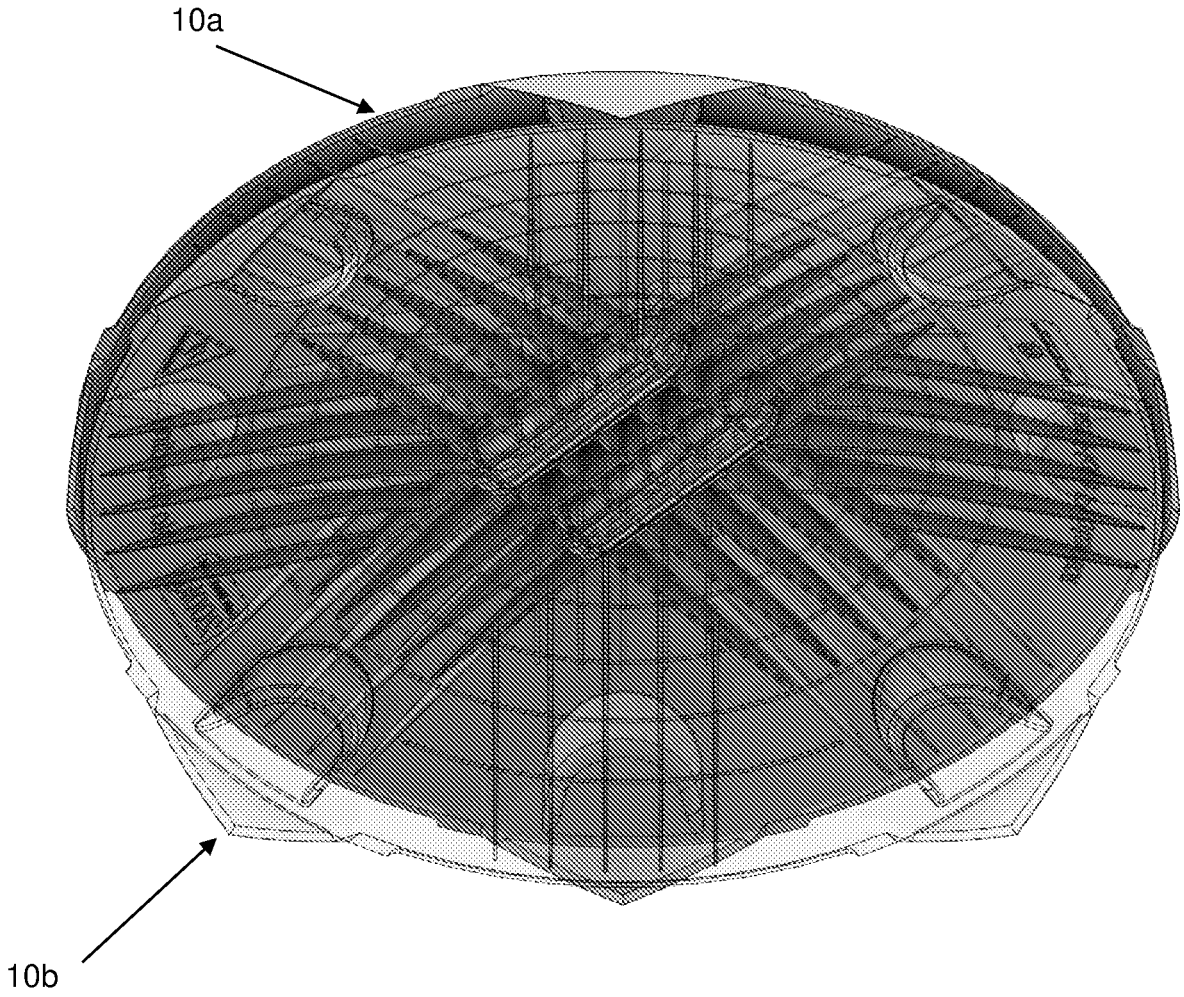
FIG. 8 illustrates a bottom isometric view of a pair of post hole covers according to an embodiment of the present invention.

FIG. 8 illustrates a bottom isometric view of a pair of post hole covers 10*a*, 10*b* according to an embodiment of the present invention. The post hole covers 10*a*, 10*b* are shown stacked on top of one another, for example for storage or transportation.

The manner in which the post hole covers 10*a*, 10*b* of FIG. 8 are stacked is essentially the same as that shown in FIG. 4. However, the post hole covers 10*a*, 10*b* of FIG. 8 are identical to the post hole cover of FIG. 7.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A post hole cover comprising a substantially dome-shaped cover portion adapted to substantially overlie a post hole and one or more ground-engaging members extending from the cover portion, wherein the cover portion includes one or more substantially planar installation portions adapted to facilitate installation of the post hole cover over the post hole, wherein the installation portions comprise lands, shoulders or recesses in an upper surface of the cover portion, wherein an upper surface of the cover portion is provided with one or more grip portions, and wherein the grip portions comprise a plurality of annular ribs extending at least partway about the cover portion.

2. A post hole cover comprising a substantially dome-shaped cover portion adapted to substantially overlie a post hole and one or more ground-engaging members extending from the cover portion, wherein the cover portion includes one or more substantially planar installation portions adapted to facilitate installation of the post hole cover over the post hole, wherein the installation portions comprise lands, shoulders or recesses in an upper surface of the cover portion, wherein the post hole cover is provided with one or more handle portions, and wherein the handle portions comprise at least a pair of recesses, slots or channels extending into an upper surface of the cover portion.

3. The post hole cover of claim 1 wherein the post hole cover is provided with one or more reinforcing members adapted to increase one or more of the strength, rigidity, load-bearing capability, and durability of the post hole cover.

4. The post hole cover of claim 3 wherein the one or more reinforcing members are provided on a lower surface of the cover portion.

5. The post hole cover of claim 3 wherein the one or more reinforcing members comprise ribs.

6. The post hole cover of claim 5 wherein the ribs are in contact with the lower surface of the cover portion along their entire length.

7. The post hole cover of claim 5 wherein the post hole cover comprises a first plurality of ribs extending in a first direction and a second plurality of ribs extending in a second direction.

8. The post hole cover of claim 7 wherein the first direction and the second direction are oriented at an angle of about 90° to one another.

9. The post hole cover of claim 1 wherein the ground-engaging members extend at an angle of between about 85° and about 95° to the periphery of the cover portion.

10. The post hole cover of claim 1 wherein the ground-engaging members are shaped so as to form one or more points adapted to penetrate a ground surface adjacent the post hole.

11. The post hole cover of claim 10 wherein the ground-engaging members are substantially triangular in shape, with a point or apex of the triangle adapted to penetrate the ground surface.

12. The post hole cover of claim 10 wherein the ground-engaging members are adapted to penetrate the ground surface to such a depth that at least a portion of the cover portion is located in abutment with the ground surface.

13. The post hole cover of claim 1 wherein the installation portions are adapted to provide one or more regions of the post hole cover to which pressure is applied to facilitate penetration of the ground surface by the ground-engaging members.

14. The post hole cover of claim 1 wherein each of the one or more installation portions at least partially overlies, or is positioned adjacent, a ground-engaging member.

15. The post hole cover of claim 1 wherein the post hole cover is fabricated from a polycarbonate or a combination of polycarbonates.

16. The post hole cover of claim 2 wherein the post hole cover is provided with one or more reinforcing members adapted to increase one or more of the strength, rigidity, load-bearing capability, and durability of the post hole cover.

17. The post hole cover of claim 16 wherein the one or more reinforcing members are provided on a lower surface of the cover portion.

18. The post hole cover of claim 16 wherein the one or more reinforcing members comprise ribs.

19. The post hole cover of claim 18 wherein the ribs are in contact with the lower surface of the cover portion along their entire length.

20. The post hole cover of claim 18 wherein the post hole cover comprises a first plurality of ribs extending in a first direction and a second plurality of ribs extending in a second direction.

21. The post hole cover of claim 20 wherein the first direction and the second direction are oriented at an angle of about 90° to one another.

22. The post hole cover of claim 2 wherein the ground-engaging members extend at an angle of between about 85° and about 95° to the periphery of the cover portion.

23. The post hole cover of claim 2 wherein the ground-engaging members are shaped so as to form one or more points adapted to penetrate a ground surface adjacent the post hole.

24. The post hole cover of claim 23 wherein the ground-engaging members are substantially triangular in shape, with a point or apex of the triangle adapted to penetrate the ground surface.

25. The post hole cover of claim 23 wherein the ground-engaging members are adapted to penetrate the ground surface to such a depth that at least a portion of the cover portion is located in abutment with the ground surface.

26. The post hole cover of claim 2 wherein the installation portions are adapted to provide one or more regions of the post hole cover to which pressure is applied to facilitate penetration of the ground surface by the ground-engaging members.

27. The post hole cover of claim 2 wherein each of the one or more installation portions at least partially overlies, or is positioned adjacent, a ground-engaging member.

28. The post hole cover of claim 2 wherein the post hole cover is fabricated from a polycarbonate or a combination of polycarbonates.

* * * * *